US007580542B2

(12) United States Patent
Ohashi et al.

(10) Patent No.: US 7,580,542 B2
(45) Date of Patent: Aug. 25, 2009

(54) LOUDSPEAKER APPARATUS

(75) Inventors: Yoshio Ohashi, Kanagawa (JP); Masaru Uryu, Chiba (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/233,416

(22) Filed: Sep. 22, 2005

(65) Prior Publication Data

US 2006/0072777 A1 Apr. 6, 2006

(30) Foreign Application Priority Data

Oct. 5, 2004 (JP) ..... 2004-292875

(51) Int. Cl.
*H04R 25/00* (2006.01)

(52) U.S. Cl. ..... 381/430; 381/398; 381/423

(58) Field of Classification Search ..... 381/398, 381/423, 424, 426, 429, 430; 181/157, 161, 181/163–167, 171–173; 29/594, 609.1
See application file for complete search history.

(56) References Cited

U.S. PATENT DOCUMENTS

| | | | | |
|---|---|---|---|---|
| 2,084,945 A * | 6/1937 | Cornwell | ..... | 381/407 |
| 4,531,608 A * | 7/1985 | Heinz | ..... | 181/172 |
| 6,359,996 B1 * | 3/2002 | Ohashi | ..... | 381/401 |

FOREIGN PATENT DOCUMENTS

| | | | |
|---|---|---|---|
| JP | 55-68893 U | | 12/1980 |
| JP | 2003-348691 | * | 12/2003 |
| JP | 2003-348691 A | | 12/2003 |
| JP | 2004-023297 | | 1/2004 |

* cited by examiner

*Primary Examiner*—Huyen D Le
(74) *Attorney, Agent, or Firm*—Lerner, David, Littenberg, Krumholz & Mentlik, LLP

(57) ABSTRACT

A loudspeaker apparatus in which a diaphragm is reinforced easily and favorably. The loudspeaker apparatus includes a loudspeaker diaphragm formed by joining a domed diaphragm and an edge-like diaphragm and vibrated using a voice coil, and a reinforcement ring reinforcing a junctional flat portion or the vicinity of the junctional flat portion of the diaphragm. The reinforcement ring is formed of a permeable material, and the permeable reinforcement ring is stuck to the junctional flat portion or the vicinity of the junctional flat portion of the diaphragm.

5 Claims, 4 Drawing Sheets

LOUDSPEAKER APPARATUS

CROSS-REFERENCE TO RELATED APPLICATIONS

The present application claims priority from Japanese Patent Application No. JP 2004-292875 filed on Oct. 5, 2004, the disclosure of which is hereby incorporated by reference herein.

BACKGROUND OF THE INVENTION

The present invention relates to a loudspeaker apparatus used for a variety of acoustic devices, video devices and the like, particularly to a loudspeaker apparatus in which the strength of a junctional flat portion of an acoustic diaphragm has been improved.

As an acoustic diaphragm used for a loudspeaker apparatus in related art, there is an acoustic diaphragm 10 shown in FIG. 1, for example. FIG. 1 shows a construction which has been cut in half for an explanation. The acoustic diaphragm 10 includes a domed diaphragm 11 shaped like a dome in the center, and an edge-like diaphragm 12, which is formed of a macromolecular film, metal or the like, and is integrally formed in such a manner as to have a predetermined curvature of concavity or convexity or to be linear in cross section from the circular edge of this domed diaphragm 11. Further, a diaphragm edge 14 is integrally formed so as to be connected to the outer circumferential portion of the edge-like diaphragm 12 through a junctional flat portion 13.

A bobbin 16 on which a voice coil 17 is wound is joined to the junction of the acoustic diaphragm 10, where the domed diaphragm 11 and the edge-like diaphragm 12 are combined to a single unit, in such a manner as to hang down, and the voice coil 17 is disposed inside a gap forming magnetic space not shown in the figure to oscillate up and down, and thus a loudspeaker apparatus is assembled. Adhesive is used for joining the acoustic diaphragm 10 and the bobbin 16 together.

A loudspeaker apparatus using this acoustic diaphragm shown in FIG. 1 is constructed, for example, as a dynamic loudspeaker which is relatively small and is capable of reproducing up to a high frequency (for example 100 kHz). Since this kind of acoustic diaphragm 10 has been obtained by integrally molding a thin metal sheet of, for example, aluminum, titanium, or a macromolecular sheet or the like, there has been an inconvenience that the metal sheet and macromolecular sheet at the portion where the domed diaphragm 11 and the edge-like diaphragm 12 are joined together becomes thin due to being stretched in both the directions of the domed diaphragm 11 and the edge-like diaphragm 12 when shaped into a diaphragm, with the result that mechanical strength of the joined portion decreases.

Also, if the bobbin 16 is stuck to the junction between the domed diaphragm 11 and the edge-like diaphragm 12, and an acoustic signal is input to the voice coil 17, a predetermined frequency will cause the vibrations of the domed diaphragm 11 and the edge-like diaphragm 12, whose phases are different by 180 degrees, with the thin, mechanically weak junctional flat portion 13 being a node. With this frequency, there has been an inconvenience in which an acoustic signal emitted from the domed diaphragm 11 and an acoustic signal emitted from the edge-like diaphragm 12 are mutually cancelled, causing a dip in acoustic pressure. Particularly, if this dip is in the audible band, there has been an inconvenience in which the quality of acoustic signals is lowered.

Further, on high frequencies of 20 kHz or more, driving force from the bobbin 16 is absorbed by adhesive and the adhesive surface of the mechanically weak diaphragm 10, and so the driving force is not transmitted to the edge-like diaphragm 12. Thus, a problem in which the necessary acoustic pressure may not be obtained on high frequencies of 20 kHz or more remains to be solved.

As shown in FIG. 2, in order to solve the above problems, the inventor of the present invention and others previously proposed in Japanese Published Patent Application No. 2003-348691 a construction in which a reinforcement ring 15 made of a resinous film is attached to the adhesive point of a bobbin 16 of an acoustic diaphragm 10, and so the bobbin 16 can be installed through the reinforcement ring 15. By thus attaching a bobbin to an acoustic diaphragm through a reinforcement ring, the mechanical strength of the relevant part increases, thereby solving the above-mentioned problems.

There will be no problem arising if the above-mentioned reinforcement ring is made into a shape in advance which is suitable to be stuck and fixed, and then it is stuck and fixed using adhesive, after a loudspeaker diaphragm formed by joining a domed diaphragm and an edge-like diaphragm has been molded. However, if a reinforcement ring is stuck and fixed when a loudspeaker diaphragm is formed by joining a domed diaphragm and an edge-like diaphragm to be molded, the following problems will arise.

Specifically, if molding is executed in accordance with press molding, pneumatic molding, vacuum molding or a molding method combining those, using an extremely impermeable resinous film such as polyethylene terephthalate, polyethylene naphthalate, polyimide, polyetherimide or polycarbonate, an extremely impermeable metal film such as aluminum or titanium or other impermeable film as the material for a loudspeaker diaphragm, through-holes of some kind are provided or a porous mold is used to allow air existing between a film and a diaphragm-molding mold to escape. If a reinforcement ring is stuck and fixed using those extremely impermeable materials, when molding a diaphragm, by means of a diaphragm-molding method, it is necessary to allow air existing between the diaphragm and the reinforcement ring to escape by some means. If a reinforcement ring is made of, for example, the above-mentioned resinous film, it is relatively easy to shape the resinous film into a reinforcement ring, but air is left between a diaphragm and the reinforcement ring when the diaphragm is molded, so that there is a problem that the diaphragm and the reinforcement ring are not firmly stuck to each other.

If air is left between a diaphragm and a reinforcement ring in this manner, adhesive strength between the reinforcement ring and the diaphragm decreases to the extent, eventually causing a problem in which the above-mentioned insufficient mechanical strength of a diaphragm may not be solved.

The present invention is designed in light of the above, and aims to provide a loudspeaker apparatus in which a diaphragm of a loudspeaker apparatus is reinforced easily and favorably.

SUMMARY OF THE INVENTION

A loudspeaker apparatus according to an embodiment of the present invention includes: a loudspeaker diaphragm formed by joining a domed diaphragm and an edge-like diaphragm and vibrated using a voice coil, and a reinforcement ring reinforcing a junctional flat portion or the vicinity of the junctional flat portion of the diaphragm, in which the reinforcement ring is formed of a permeable material, and the permeable reinforcement ring is stuck to the junctional flat portion or the vicinity of the junctional flat portion of the diaphragm.

By doing so, as the adhered state in which the reinforcement ring adheres to the diaphragm, a favorable state is obtained in which air is not left because of the permeability of the reinforcement ring itself, and so the reinforcement ring sticks firmly to the diaphragm.

According to an embodiment of the present invention, as the adhered state in which a reinforcement ring adheres to a diaphragm, a favorable adhered state is obtained in which air is not left because of the permeability of the reinforcement ring itself, and so the reinforcement ring sticks firmly to the diaphragm, thereby surely reinforcing a bobbin attachment portion of the diaphragm. Therefore, the mechanical strength of a junctional flat portion of the diaphragm where a domed diaphragm and an edge-like diaphragm have been integrally molded can be enhanced, and thus the most efficient conversion from a vibration to an acoustic output can be performed, thereby providing a loudspeaker apparatus capable of reproducing up to a high frequency, for example 100 kHz.

In this case, in order to adhere to the diaphragm, the reinforcement ring is put into a state in which the reinforcement ring has permeability with adhesive being applied thereto, and thereby permeability is surely secured at the time of an adhesive operation to obtain a favorable adhesive state.

Further, in that case, when using a thermoplastic adhesive as the adhesive applied to the reinforcement ring, the reinforcement ring can firmly be stuck to the diaphragm easily and surely without any space therebetween in the heat formation processing of the diaphragm.

Further, as the permeable capacity of the reinforcement ring, sufficient permeable capacity can be obtained with the air permeability resistance of 100 seconds or less.

DETAILED DESCRIPTION

Hereinafter, an embodiment of the present invention will be explained referring to FIGS. 3 to 8.

Figure 5:
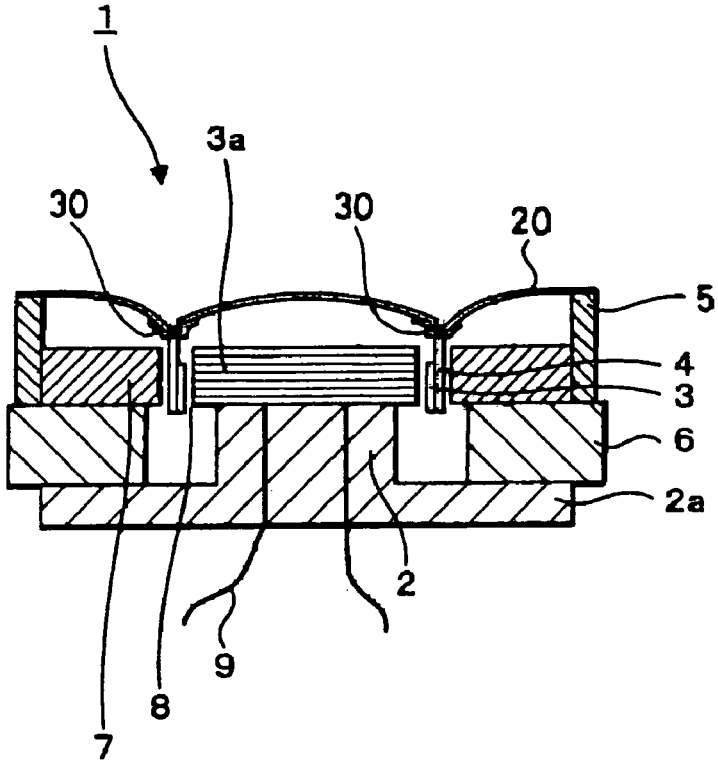
FIG. 5 is a cross-sectional view showing a construction of a loudspeaker apparatus according to an embodiment of the present invention.
Figure 6:
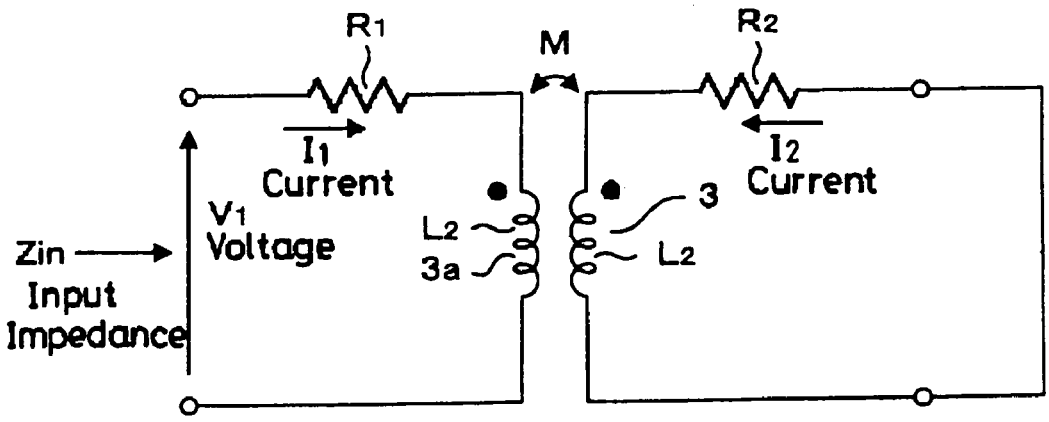
FIG. 6 is an equivalent circuit diagram for explaining operations performed in FIG. 5.

This embodiment shows an example in which the present invention is applied to a dynamic electromagnetic induction loudspeaker, and first the whole construction of the dynamic electromagnetic induction loudspeaker of this embodiment is explained, referring to FIGS. 5 and 6. FIG. 5 shows a sectional side view of a dynamic electromagnetic induction loudspeaker of this embodiment, and FIG. 6 shows an equivalent circuit of the dynamic electromagnetic induction loudspeaker shown in FIG. 5.

In FIG. 5, a loudspeaker apparatus 1 includes a frame portion, an acoustic diaphragm and drive means. The frame is integrally formed with a lower surface plate 2*a* made of a disk-shaped metal in the approximate center of the lower surface plate 2*a*, a columnar pole piece 2 which is smaller in diameter than the lower plate is provided in an upright position, and a concentric magnet 6 is joined to the lower surface plate 2*a* in such a manner as to surround the periphery of this pole piece 2.

Further, a plate-shaped upper surface plate 7 made of a concentrically-formed metal is joined onto the magnet 6. The frame potion is formed by combining a cylindrical frame 5, which has been fitted into the periphery of the upper surface plate 7, and the upper surface plate 7 into a single unit.

As described later, an acoustic diaphragm 20 includes a convex domed diaphragm at the center, and an edge-like diaphragm provided from the edge of this domed diaphragm to have a curvature R or to be linear in cross section.

Also, regarding the drive means of the electromagnetic induction loudspeaker, an excitation primary coil 3*a* which is insulated and wound on the pole piece 2 or on a disk-shaped pole piece plate, not shown in the figure, fixed on the pole piece 2 is disposed facing a conductive ring 3 which is fitted into the inner circumference of a bobbin 4 hanging down from an later-mentioned junctional flat portion of the acoustic diaphragm 20 into a gap 8 formed between the inner circumference of the upper surface plate 7, to be capable of electromagnetic induction; on supplying a driving current such as an acoustic input signal via a signal input line 9, a current which flows through the excitation primary coil 3*a* changes and thus a magnetic field generated by the magnet 6 and by the excitation primary coil 3*a* changes, so that an induction current flows through the conductive ring 3 and thus the conductive ring 3 vibrates up and down by means of electromagnetic force, eventually making the acoustic diaphragm 20 vibrate correspondingly.

FIG. 6 shows an equivalent circuit of an induction portion of the dynamic electromagnetic induction loudspeaker shown in FIG. 5; on supplying an voltage $V_1$ equivalent to an acoustic input signal to a resistance $R_1$ and an inductance $L_1$ on the primary side of an input impedance Zin equivalent to the excitation primary coil 3*a* shown in FIG. 5, an electric current $I_1$ flows, and an electric current $I_2$ equivalent to an output signal flows through a resistance $R_2$ and an inductance $L_2$ on the secondary side equivalent to the conductive 1-turn ring 3 by means of induction by a mutual inductance M, so that driving force with which to move the conductive 1-turn ring 3 up and down is generated, thereby emitting an acoustic signal from the acoustic diaphragm 20.

Figure 1:
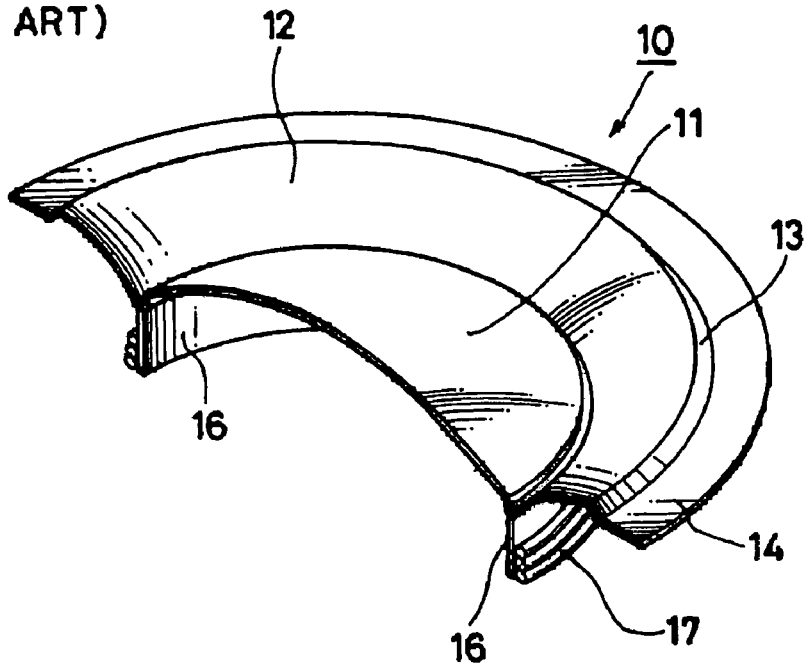
FIG. 1 (RELATED ART)
FIG. 1 is a perspective view showing a fractured example of a diaphragm in related art.
Figure 2:
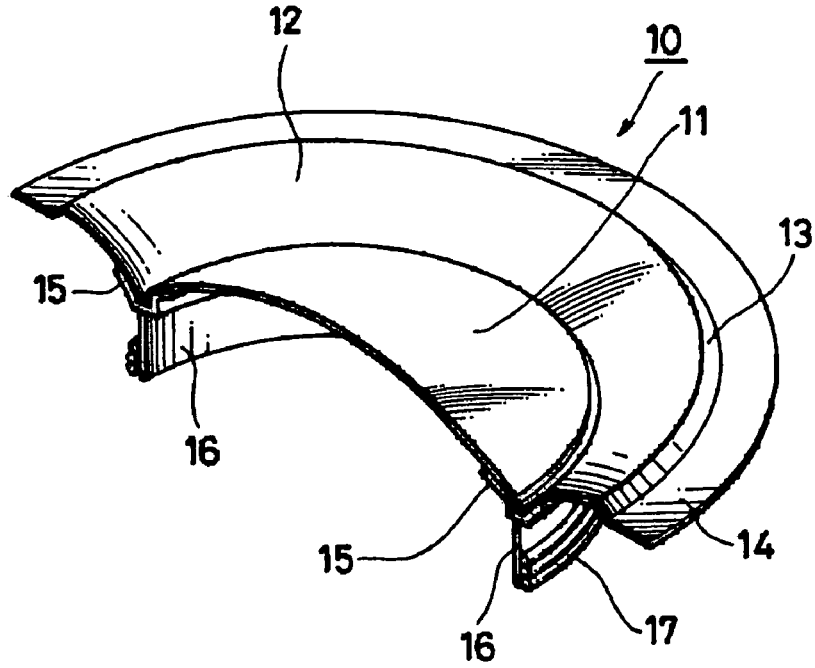
FIG. 2 (RELATED ART)
FIG. 2 is a perspective view showing a fractured example of a diaphragm having a reinforcement ring in related art.
Figure 3:
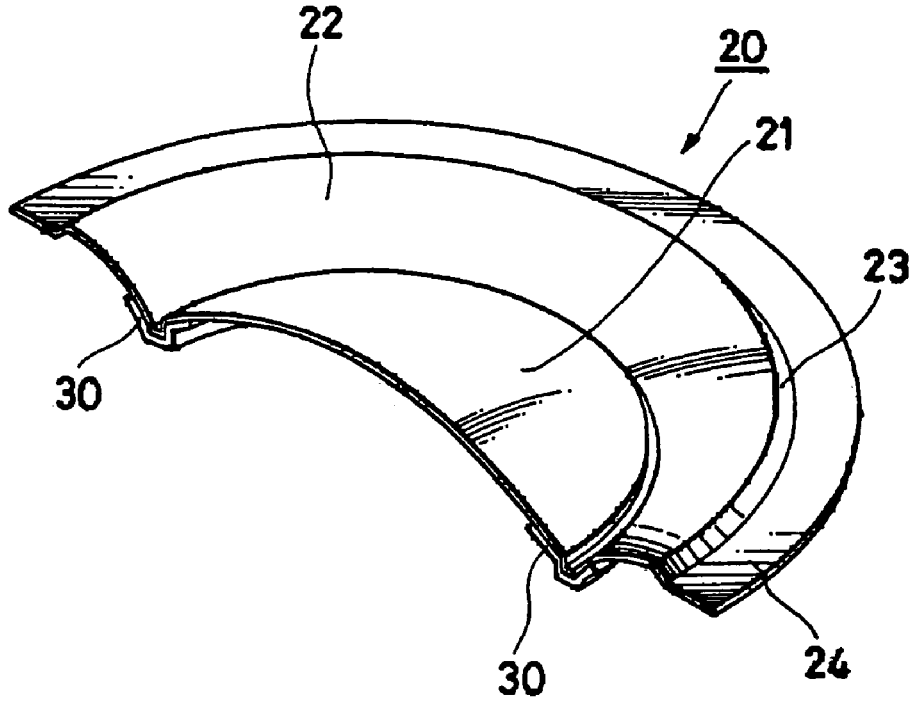
FIG. 3 is a perspective view showing a fractured diaphragm used in a loudspeaker apparatus according to an embodiment of the present invention.

Next, the construction of an acoustic diaphragm 20 of this embodiment which is attached to a loudspeaker apparatus thus constructed is explained. FIG. 3 is a figure showing a loudspeaker acoustic diaphragm 20 of this embodiment which has been fractured in half. The acoustic diaphragm 20 includes in the center a domed diaphragm 21, and an edge-like diaphragm 22 from the circular edge of this domed diaphragm 21, which is integrally formed to have a predetermined curvature of concavity or convexity or to be linear in cross section and is formed of an extremely impermeable material such as a macromolecular film or a metal. Further, a diaphragm edge 24 is integrally formed to be connected to the outer circumferential portion of the edge-like diaphragm 22 through a junctional flat portion 23. The construction of the acoustic diaphragm 20 thus explained is the same as that of the acoustic diaphragm 10 shown in FIGS. 1 and 2 as related art.

Further, as shown in FIG. 5, a bobbin 4 on which a conductive ring 3 equivalent to a voice coil is wound is joined to the junction of the acoustic diaphragm 20, where the domed diaphragm 21 and the edge-like diaphragm 22 are combined into a single unit such that the bobbin 4 hangs down; between the acoustic diaphragm 20 and the bobbin 4 is disposed a reinforcement member (reinforcement ring) 30 shaped like a ring.

Figure 4:
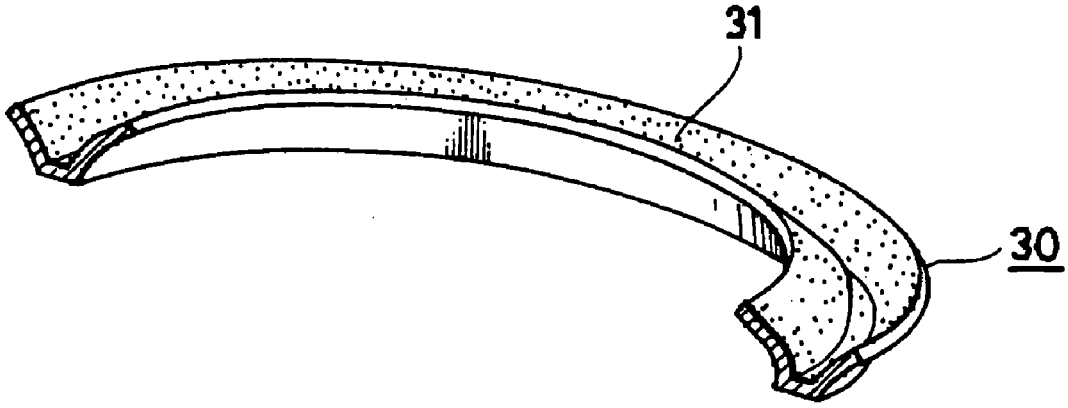
FIG. 4 is a perspective view showing a fractured reinforcement ring used in a loudspeaker apparatus according to an embodiment of the present invention.

FIG. 4 is a view showing a fractured reinforcement member 30 of this embodiment which is broken in half. A reinforcement member 30 of this embodiment is made of a permeable material such as paper, a woven fabric of resinous fiber or an unwoven fabric. In addition, one surface of the ring-shaped reinforcement member 30 is made into an adhesive application surface 31. In this case, a thermoplastic adhesive such as hot-melt adhesive is used as an adhesive applied to the adhesive application surface 31, to adhere to the diaphragm 20 in a heating process. Further, regarding a state in which adhesive is applied to the adhesive application surface 31, granular adhesive is applied unevenly (namely, with space to some extent), for example, so that the reinforcement member 30 remains permeable even with the adhesive applied.

Regarding the permeability of the reinforcement member 30, the Gurley value showing the air permeability can be used as an index, for example. It is preferable that the Gurley value of the material forming the reinforcement member 30, using a Gurley Densometer B type, be 0.1-100 secs./100 cc, for example. If the value is greater than this, air existing between the diaphragm 20 and the reinforcement member 30 may not be sufficiently removed in a later-mentioned production process due to insufficient practical permeable capacity, with the result that its function may not be well performed. On the other hand, if the value is smaller than this, mechanical strength could be insufficient.

Although in FIG. 4, the ring-shaped reinforcement member 30 is almost made V-shaped so as to match the shape of the junction of the acoustic diaphragm 20, where the domed diaphragm 21 and the edge-like diaphragm 22 are combined into a single unit, the reinforcement member 30 may be a flat cutout shaped like a ring in actuality and it becomes what is shown in FIG. 4 in a production process to adhere to the acoustic diaphragm 20.

Figure 7:
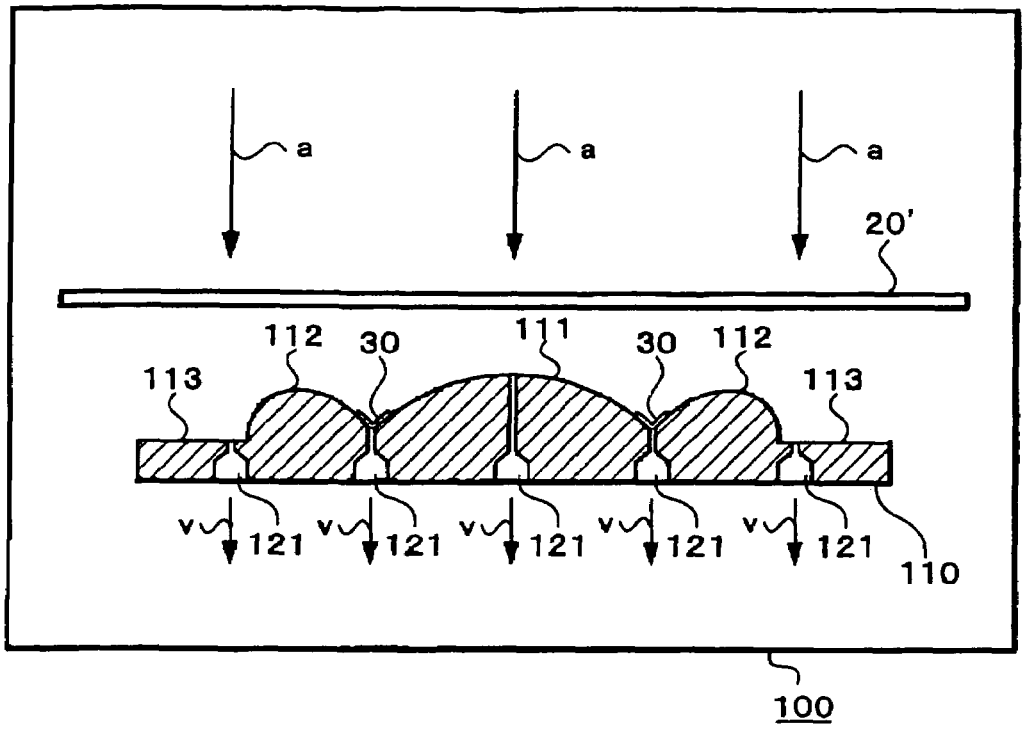
FIG. 7 is a cross-sectional view showing a forming state (before the formation) of a diaphragm according to an embodiment of the present invention.
Figure 8:
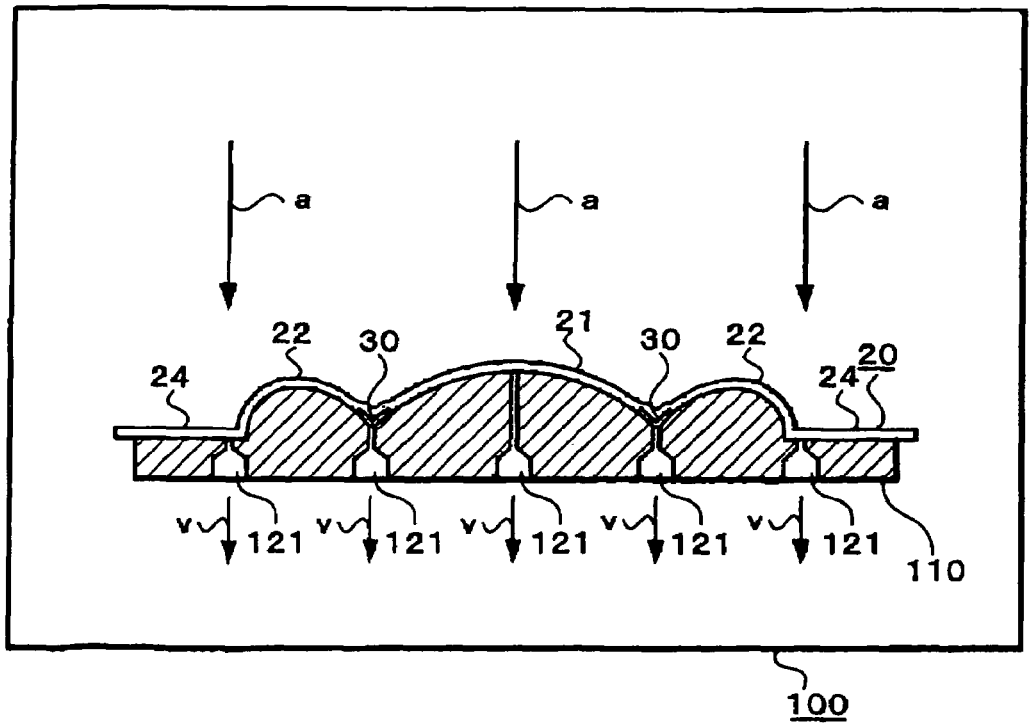
FIG. 8 is a cross-sectional view showing a forming state (after the formation) of a diaphragm according to an embodiment of the present invention.

Next, treatment in the production process of sticking the reinforcement member 30 to the acoustic diaphragm 20 is explained, referring to FIGS. 7 and 8. In this embodiment, the reinforcement member 30 is concurrently stuck in the process in which a flat acoustic diaphragm formation film 20' shaped like a plate is formed as the acoustic diaphragm 20 shown in FIG. 3.

FIG. 7 is a figure showing an example of performing a process in which an acoustic diaphragm 20 is formed. Here, the flat acoustic diaphragm formation film 20' shaped like a plate is pressed against a mold 110 disposed in a chamber 100 to form the acoustic diaphragm 20 of FIG. 3. The mold 110 has such a shape as corresponds to the shape of the diaphragm 20, by including a domed diaphragm formation portion 111, an edge-like diaphragm formation portion 112, a diaphragm edge formation portion 113 and the like.

At the time of formation, this mold 110 is heated, and then the film 20' is pressed against the mold 110 with high-pressure air as shown by the arrows a. Further, a plurality of vents 121 are formed in the mold 110, and the film 20' adheres to the surface of the mold 110 by executing suction from those vents 121 as shown by the arrows v, thereby being formed into an acoustic diaphragm 20 of a predetermined shape, as shown in FIG. 8.

Here, in this embodiment, as shown in FIG. 7, a ring-shaped reinforcement member 30 is disposed in advance at the portion of the mold 110 where the junction between a domed diaphragm 21 and an edge-like diaphragm 22 is formed. On this occasion, the adhesive application surface 31 of the reinforcement member 30 is a surface on the side not in contact with the mold 110 (the upper side in FIG. 7). Further, an adhesive applied to the adhesive application surface 31 is an adhesive which melts at a heating temperature at the time of this formation.

By forming the acoustic diaphragm 20 with the ring-shaped reinforcement member 30 disposed in this manner, the reinforcement member 30 becomes stuck to the acoustic diaphragm 20 when the formation has been completed, as shown in FIG. 8. Here, in the case of this embodiment, since an impermeable material is used for the acoustic diaphragm 20 itself, the film which forms the acoustic diaphragm 20 adheres, being pressed with high-pressure air as shown by the arrows a, and being sucked from the vents 121 of the mold 110 as shown by the arrows v; however, on that occasion, since the reinforcement member 30 disposed is made of a permeable material, the reinforcement member 30 does not hinder aspiration from the vents 121. Therefore, air does not stay between the acoustic diaphragm 20 and the reinforcement member 30, and so the reinforcement member 30 is stuck to the acoustic diaphragm 20 being firmly adhered to the acoustic diaphragm 20.

Since an acoustic diaphragm 20 to which a reinforcement member 30 is firmly stuck is obtained in this manner, a loudspeaker apparatus with favorable characteristics can be obtained by assembling a loudspeaker apparatus with this diaphragm 20 as shown in FIG. 5. In other words, adhesive strength between a ring-shaped reinforcement member and a diaphragm can be sufficiently maintained, the diaphragm has as sufficient mechanical strength as is necessary, and acoustic characteristics can be maintained favorably. For example, a loudspeaker apparatus capable of reproducing virtually evenly up to a high frequency can be obtained.

It should be noted that although an example in which the present invention has been applied to an electromagnetic induction loudspeaker apparatus is described in the embodiment explained thus far, the present invention can also be applied to an acoustic diaphragm of a standard dynamic loudspeaker apparatus.

It should be understood by those skilled in the art that various modifications, combinations, sub-combinations and alterations may occur depending on design requirements and other factors insofar as they are within the scope of the appended claims or the equivalents thereof.

The invention claimed is:

1. A loudspeaker apparatus, comprising:

a loudspeaker diaphragm formed by joining a domed diaphragm and an edge diaphragm, and operable to vibrate using a voice coil, and a reinforcement ring reinforcing and adhered to a junction flat portion between said domed diaphragm and said edge diaphragm, wherein the reinforcement ring is adhered to the junction flat portion during the joining of the domed diaphragm and the edge diaphragm by molding, wherein said reinforcement ring is formed of a permeable material other than paper and has air permeability resistance of 100 seconds or less as the permeable capacity, such that substantially no air is between the reinforcement ring and the junction flat portion after the reinforcement ring has been adhered to the junction flat portion.

2. A loudspeaker apparatus according to claim 1, wherein said reinforcement ring, prior to being adhered to the junction flat portion, includes an adhesive application surface on which a thermoplastic adhesive is unevenly spaced, and wherein the ring is adhered to the junction flat portion, for reinforcing the junction flat portion, by heating the ring, and wherein, during the heating of the ring, the reinforcement ring has permeability to air while the adhesive application surface of the reinforcement ring is being adhered to the junction flat portion.

3. A loudspeaker apparatus according to claim 2, wherein said reinforcement ring has a Gurley value for air permeability in a range of approximately 0.1 to 100 seconds per 100 cc.

4. A loudspeaker apparatus according to claim 1, wherein said reinforcement ring is located between said domed diaphragm and said edge diaphragm.

5. A loudspeaker apparatus according to claim 1, wherein the permeable material is woven fabric of resinous fiber or an unwoven fabric.

* * * * *